United States Patent [19]

Oborzil et al.

[11] Patent Number: 4,619,846

[45] Date of Patent: Oct. 28, 1986

[54] BELL

[76] Inventors: Edit Oborzil; Tibor Jeney, both of Jegenye u. 25., 1221 Budapest, Hungary

[21] Appl. No.: 734,447

[22] Filed: May 15, 1985

[30] Foreign Application Priority Data

Jul. 3, 1984 [HU] Hungary ..... 2574/84

[51] Int. Cl.[4] ..... G10K 1/00

[52] U.S. Cl. ..... 428/11; 116/148

[58] Field of Search ..... 428/11; 84/406, 407; 116/148, 149

[56] References Cited

U.S. PATENT DOCUMENTS

| | | | |
|---|---|---|---|
| 203,675 | 5/1878 | Tucker | 428/11 X |
| 581,780 | 5/1897 | Shaaber | 116/148 |
| 1,570,145 | 1/1926 | Heller | 428/11 |
| 1,596,314 | 8/1926 | Schneider | 428/11 |
| 2,222,571 | 11/1940 | Osborne | 428/11 |
| 3,070,919 | 1/1963 | Peckham | 428/11 X |
| 4,513,035 | 4/1985 | Barfield et al. | 428/11 |

FOREIGN PATENT DOCUMENTS

| | | | |
|---|---|---|---|
| 716828 | 1/1942 | Fed. Rep. of Germany | 116/148 |

*Primary Examiner*—Henry F. Epstein

*Attorney, Agent, or Firm*—Handal & Morofsky

[57] ABSTRACT

A bell having a mantle which is fully broken through by a plurality of gaps longitudinally and axially formed along the circumference of the mantle and dimensioned to tune the bell to a predetermined tonal frequency range.

2 Claims, 1 Drawing Figure

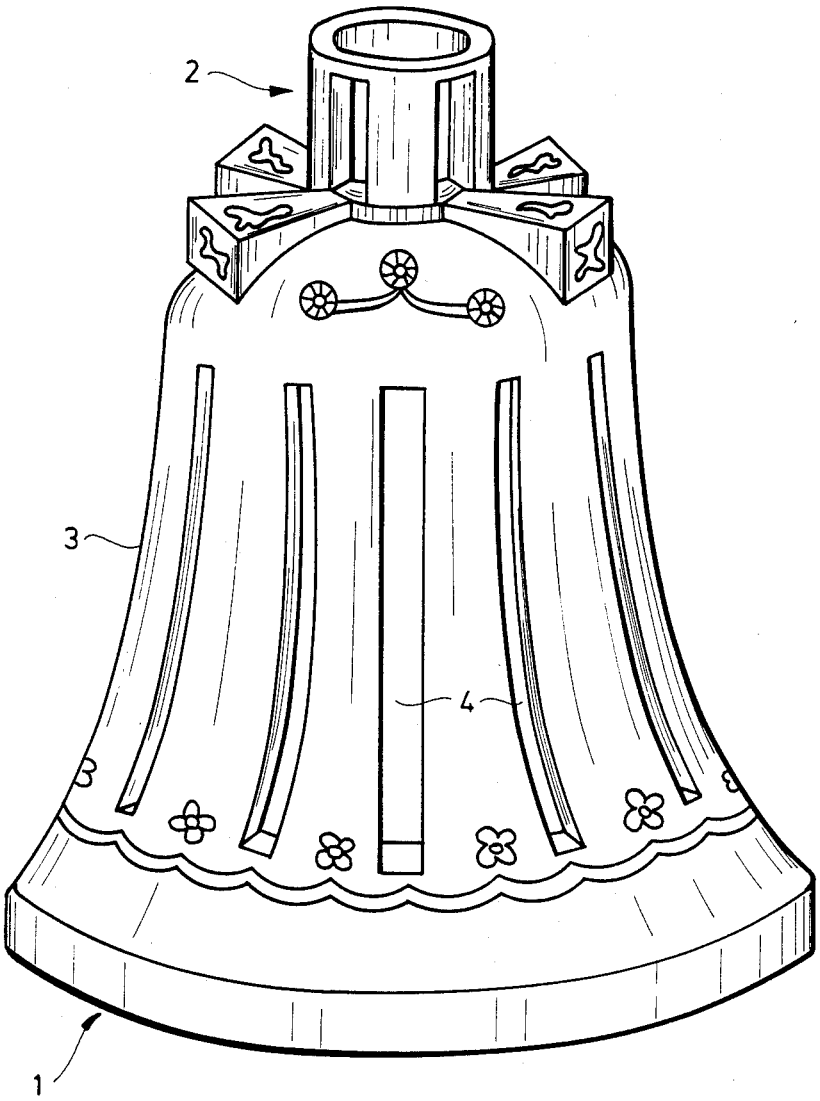
2
3
4
1

BELL

FIELD AND BACKGROUND OF THE INVENTION

The invention relates to a bell made of aluminium or aluminium alloy, respectively, having a well defined pitch of tone and long reverberation period.

Bells have been used for a many hundred years for producing musical sounds, for signalling time or the happening of some event, as well as a striking punctuating instrument, articulating the melody in an orchestra. Known forms of bells serve as idiophone instruments as well.

A bell can be considered as a complicated three-dimensional plate, which performs two-dimensional vibration when struck. In course of the two-dimensional vibration two systems of nodal lines are formed, the system of longitudinal nodal lines and the system of circular nodal lines.

The system of longitudinal nodal lines consists of nodal lines which lie in vertical planes containing the longitudinal vertical axis of the bell (when it is in its freely hanging position on the hanger), these nodal lines have approximately the same shape as the generatrices of the bell mantle and divide the bell mantle into 4 to 12 zones along the periphery. Out of the longitudinal nodal lines the largest amplitude of vibration can be observed on the nodal line which receives the stroke from the striking means, e.g. from the bell-hammer.

The other system of nodal lines arising in course of vibration consists of circular nodal lines lying in planes running perpendicularly to the longitudinal axis of the bell having been separated from each other by a space along the longitudinal axis and the centers of the circular nodal lines are lying on the longitudinal axis.

At the location of the longitudinal and circular nodal lines the bell mantle practically does not perform any oscillatory motion. Vibration modules of the longitudinal and circular nodal lines may freely combine.

On the bell, vibration with the largest amplitude is performed by the lower edge, on the flange of the bell. The flange can be considered as if it were the free edge of a clamped rod or plate. Vibration and sounds originate from the flange. The bell is almost vibrating in its entirety, with the exception of the place of holding, which is on the top, in the middle.

The tolling sound is composed of two parts: First of all the "striking sound", being a single short sound with metallic clinking, with a defined pitch of tone. The striking sound is considered the sound of the bell. After a short time the striking voice stops, decay takes place very quickly. Striking voice is the residuum of an overtone, the subjective prime tone.

Prior to complete decay of the striking sound the so-called "humming sound" enters which can be characterized by the formed state of vibration of the bell mantle, being a polyphone chord and decaying slowly. The humming sound consists of several members, mostly the prime tone, the lower sound, the third fifth and the upper octave. Out of these the lower sound is tolling for the longest time, the other ones weaken relatively fast.

The two types of bellsounds have different tonalities. The striking voice has considerable metallic clinking, meaning a plurality of non-harmonic overtones, in this case pitch of sound might be uncertain.

The humming sound is softer and it is a subdued tone. In the course of gradual decay the chord becomes increasingly clear, the sounds (overtones) are fading one after the other, at last only the lower tone tolls.

The described pattern of sounds depend on the formation of the bell mantle, it is influenced neither by the force of stroke, nor by the composition of the bell material, as these only regulate but the number and the strength of the overtones.

A bell of good quality is required to have a well defined pitch of tone and a long period of reverberation. A further requirement in respect of bell production lies in that production could be performed economically and in an easy manner, either individual pieces are produced, or serial production is desirable. With bells of known design all requirements cannot be met simultaneously.

With known bell types syntonization of striking sound and humming sound represents a difficult task. The main reason lies in that the bell mantle is vibrating around two sytems of nodal lines, being practically normal to one another and the systems of the nodal lines exert a mutual influence on the environment. Composition of sounds cannot be determined in advance by calculative methods.

Pitch of sound is determined mainly by the material and diameter of the bell, it goes without saying that the weight of the bell is proportional with the diameter. It is considered as advantageous if the prescribed required pitch of tone is achieved with a bell with a possibly less diameter and weight. A given pitch of tone with the smallest diameter and the least weight can be achieved by using gold, a larger diameter and a bell weighing more, by using silver. however, use of gold and silver cannot be considered due to the high price.

Out of the materials which are well suited to attain the desired small weight and small diameter, first there is a bronze with a Cu+Sn composition, the so-called bell-bronze should be mentioned, thereafter brass with Cu+Zn composition and lastly, siliceous copper alloy with a Cu+Si+Zn composition, i.e. a siliceous bronze material. However, these are still expensive materials, and the high price results from the fact that if used for a bell, high purity if a primary requirement. So e.g. is some hundredth percents of aluminium get into the bell-bronze, reverberation period will be reduced to one third. A further disadvantageous feature of the copper alloys lies in the utmost long time of bell casting, frequently it lasts several months, whether the bell is weighing several tons, or only a kilogram. Additionally, it is possible that even after such a long time the sound of the bell does not give the required tonality.

It has been attempted to cast bells of aluminium or aluminium alloys, however, with the known bell designs both aluminium and alloys thereof proved absolutely unsuitable, to obtain a given pitch of tone even larger diameters and weights had to be produced than with the usual copper alloys.

From the point of view of long reverberation periods the bell-bronze with a Cu+Sn composition yielded the best results, with the other copper alloys satisfactory results could not be achieved. When casting bells of aluminium or aluminium alloys and having the usual formation, the bells thus founded show unacceptable short reverberation times, in addition their sound was unsatisfactory.

SUMMARY OF THE INVENTION

The aim of the invention is to develop a bellconstruction which enables application of relatively cheap aluminium and aluminium alloys results in the, founding of bells—either as individual products or as serial products—quickly and with reduced productional costs, simultaneously quick tuning and adjustment of the required pitch of tone become possible; a further requirement lies in obtaining a reverberation time which corresponds to that of bells made of bell-bronze or even longer.

In accordance with the invention the aim set is achieved by means of a bell which is made of aluminium or an aluminium alloy, which can be characterized in that in the mantle thereof, along its periphery symmetrical gaps are formed, which are separated by spaces and run essentially parallel with the longitudinal axis of the bell but at the same time they follow the shape of the mantle.

A further characteristic of the bell according to the invention lies in that the centrelines of said gaps are lying in planes containing the longitudinal axis of the bell, i.e. when seen from any point of the plane the gaps show a straight pattern.

A further characteristic lies in that the side view of the gaps or of a part thereof is arcuate and curvatures of the arcuate gaps are uni- or doubledirectional.

With a further preferred embodiment of the invention the width of the gaps or the size of the space between two gaps each is equal. An embodiment is also possible, with which at least at a part of the gaps the gap width and/or the size of the spaces between two gaps each is different.

It can be considered as advantageous, if the gaps are of different length.

BRIEF DESCRIPTION OF THE DRAWING

The bell according to the invention will be described in detail by means of the single FIGURE, showing the perspective view of the bell serving as an example.

DESCRIPTION OF THE PREFERRED EMBODIMENT

The bell to be seen in the FIGURE respectively, the bell mantle is formed in the usual manner. Between the flange of the bell 1 and the hanger 2, in the wall of the bell mantle 3 gaps 4 are formed, which—with the embodiment shown here for the sake of example—have the same shape as the longitudinal generatrices of the bell mantle and are separeted by spaces along the periphery of the bell mantle. The gaps 4 can have an equal width, however different widths are also possible. Similarly, the spaces between the gaps 4—running to the periphery—may be equal or different. The gaps can start from the hanger 2 of the bell on the same circumferential circle or on any other circumferential circle and they may end on the same circumferential circle or on different ones, however, one or more gaps 4 may extend to the edge of the flange 1. In addition, seen in the side view of the bell mantle, it can be arcuately shaped, with a curvature to one or both sides. Further, as it becomes obvious from the FIGURE, the gaps 4 may be composed of straight and arcuated sections, respectively.

The most advantageous feature of the bell according to the invention lies in that a bell with excellent parameters can be made of aluminium or an aluminium alloy. Material prices and expenditure on working time will be considerably reduced, thus productional and prime costs are also less. Labour time—from modelling to surfacial finish—amounts to some days instead of months, accordingly, it becomes possible to meet orders in a short time, i.e. to deliver small series with a short time-limit of delivery. Pitch of tone can be adjusted simply and with a minimum of tuning work, tuning can be quickly performed. Time of reverberation can be adjusted practically to the value corresponding to that of the bells made of bell-bronze or even to a higher value. Good striking sound and humming sound can be achieved with a bell made of aluminium or aluminium alloy having a small weight and diameter.

The invention is not at all restricted to large-sized and heavy bells. The formation according to the invention enables the achievement of most advantageous sound parameters and economical production even with small-sized and light bells.

What we claim is:

1. Bell made of aluminium or aluminium alloy, comprising a mantle, fully broken-through gaps (4) formed in the mantle for tuning said bell to at least a predetermined frequency range of tone, said gaps being formed along the periphery of said mantle and being separated from one another by spaces, said gaps running essentially parallel with the longitudinal axis of the bell mantle and following the shape of the bell mantle, wherein the centerlines of the gaps (4) lie in planes containing the longitudinal axis of the bell and when viewed from any point of said planes the gaps show a straight or arcuate pattern, wherein the width of the gaps and the space between two adjacent gaps are of different magnitude and, wherein the gaps are of different length.

2. Bell made of aluminium or aluminium alloy, comprising a mantle, full broken-through gaps (4) formed in the mantle for tuning said bell to at least a predetermined frequency range of tone, said gaps being formed along the periphery of said mantle and being separated from one another by spaces, said gaps running essentially parallel with the longitudinal axis of the bell mantle and following the shape of the bell mantle, wherein the centerlines of the gaps (4) lie in planes containing the longitudinal axis of the bell and when viewed from any point of said planes the gaps show a straight or arcuate pattern, wherein the spaces between two adjacent gaps are of different magnitude and, wherein the gaps are of different length.

* * * * *